US006609311B2

(12) United States Patent
Hagemann et al.

(10) Patent No.: US 6,609,311 B2
(45) Date of Patent: Aug. 26, 2003

(54) FABRIC TREATMENT DEVICE

(75) Inventors: Uwe Hagemann, Merseyside (GB); Steven Hayes, Merseyside (GB); Raymond Honey, Merseyside (GB); Colin Watt Kerr, Merseyside (GB)

(73) Assignee: Unilever Home & Personal Care USA division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/982,288

(22) Filed: Oct. 17, 2001

(65) Prior Publication Data

US 2002/0078589 A1 Jun. 27, 2002

(30) Foreign Application Priority Data

Oct. 18, 2000 (GB) ..... 0025555
Sep. 19, 2001 (GB) ..... 0122595

(51) Int. Cl.[7] ..... F26B 11/02
(52) U.S. Cl. ..... 34/597; 34/595; 222/325; 222/485
(58) Field of Search ..... 34/597, 595, 131; 222/325, 361, 485, 52

(56) References Cited

U.S. PATENT DOCUMENTS

| | | | | |
|---|---|---|---|---|
| 3,435,537 A | | 4/1969 | Rumsey, Jr. | 34/72 |
| 3,634,947 A | | 1/1972 | Furgal | 34/60 |
| 3,701,202 A | * | 10/1972 | Compa et al. | 34/72 |
| 4,014,432 A | | 3/1977 | Clothier et al. | 206/0.5 |
| 4,379,515 A | * | 4/1983 | Towsend | 222/52 |
| 4,921,131 A | * | 5/1990 | Binderbauer et al. | 222/52 |
| 5,020,240 A | | 6/1991 | Lee | 34/60 |
| 5,033,643 A | * | 7/1991 | Schumacher | 222/52 |
| 5,072,526 A | | 12/1991 | Hirota et al. | 34/60 |
| 5,176,297 A | * | 1/1993 | Mooney et al. | 222/325 |
| 5,966,831 A | | 10/1999 | Anderson | 34/60 |

FOREIGN PATENT DOCUMENTS

| | | |
|---|---|---|
| CA | 1 005 204 | 2/1977 |
| EP | 361 593 | 4/1994 |
| GB | 1 399 728 | 8/1972 |
| GB | 2 066 309 | 12/1980 |
| WO | 01/07704 B | 2/2000 |
| WO | 01/07703 | 2/2001 |

OTHER PUBLICATIONS

Co–pending application: Hagemann et al., S/N 09/983,051, Filed: Oct. 17, 2001.
PCT International Search Report in a PCT application PCT/EP 01/11785.
PCT International Search Report in a PCT application PCT/EP 01/11784.
GB Search Report in a GB application GB 0025555.4.

* cited by examiner

*Primary Examiner*—Ira S. Lazarus
*Assistant Examiner*—Kathryn S. O'Malley
(74) *Attorney, Agent, or Firm*—Kevin J. Stein

(57) ABSTRACT

The invention provides a device for treatment fabrics in a tumble dryer during multiple tumble drying cycles. The device comprises: a reservoir for storing a fabric treatment composition, means to expose fabric treatment composition from the reservoir to airflow generated inside the tumble drier and/or to directly contact fabrics in the dryer, thereby transferring a portion of the fabric treatment composition into contact with fabrics in the tumble dryer during a tumble drying cycle; means for attaching the device to the inside of the tumble dryer door preferably a hook and sucker; and optionally means for indicating to a user when the fabric treatment composition is used up.

47 Claims, 13 Drawing Sheets

FABRIC TREATMENT DEVICE

The present invention relates to a device for treating, fabrics inside a tumble dryer, in particular a device which is reusable and attaches to the inside of the tumble dryer door.

In the treatment of fabrics in a tumble dryer it is known to add one or more conditioning agents. For instance, for imparting a softening benefit to fabrics it is known from CA 1,005,204 to co-mingle fabrics in a tumble dryer with a flexible substrate carrying a normally solid fabric conditioning agent. The co-mingling of the fabrics with impregnated substrates requires the separation of the substrate from the fabrics after the completion of the tumble dryer treatment. Especially in using flexible substrates, this separation is often time-consuming in that the substrates cannot readily be located. Other disadvantages of such products include uneven product distribution following entanglement of the substrate with fabrics which can lead to greasy marks on fabrics (staining) and the tendency of such substrates to become positioned over the tumble dryer vent, thus giving virtually no benefit to the fabrics during a tumble drying cycle. Furthermore, these products are designed for single use only and therefore need to be replaced after every cycle.

For overcoming these problems it has been suggested, for instance in GB 2,066,309 and U.S. Pat. No. 3,634,947, to use conditioner dispensing articles, comprising means for attachment of the substrate to the tumble dryer wall. Other proposals, such as for instance disclosed in GB 1,399,728 involve the use of separate means for attaching the conditioning article to the tumble dryer wall.

EP-B-361593 concerns an alternative approach in which a fabric conditioning article comprises a combination of a substrate and a fabric conditioning composition, the substrate being a porous material with a specified void volume and cell count. The article of EP-B-361593 is designed to adhere to the tumble dryer wall.

It is an object of the present invention to provide an improved article suitable for treatment fabrics in a tumble dryer.

According to the present invention, there is provided a device for treating fabrics in a tumble dryer during multiple tumble drying cycles comprising: a reservoir for storing a fabric treatment composition, means to expose fabric treatment composition from the reservoir to airflow generated inside the tumble drier and/or to directly contact fabrics in the dryer, thereby transferring a portion of the fabric treatment component into contact with fabrics in the tumble dryer during a tumble drying cycle.

Preferably, the device has attachment means for attaching the device to the inside of the tumble dryer door. The provision of attachment means has a number of advantages over prior art devices. It is easier for a user to affix a device to the inside of the tumble dryer door, which swings open to face the user during loading and unloading of the tumble dryer, than it is to affix a device inside the tumble dryer drum as is the case with prior art devices. Once affixed to the inside of the tumble dryer door the device of the invention is clearly visible to the user during loading and unloading of the tumble dryer.

The device of the invention preferably comprises means for indicating to the user when the fabric treatment composition is used up, which has the advantage of enabling the user to determine when the fabric treatment composition or the device itself needs replacing. A further advantage of attachment of the device to the tumble dryer door is that it makes it easier to replace or refill the device when the fabric treatment composition is used up than is the case with prior art devices attached to the tumble dryer drum.

The device according to the invention may comprise a reservoir which is designed to be replaced when the fabric treatment composition is used up. For example, the reservoir may be provided in the form of a disposable plastic container e.g. bottle, carton or collapsible pouch which may have a peelable lid.

Alternatively, the reservoir may be designed to be recharged with a new fabric treatment composition when required. In this case the reservoir has an openable portion for charging and, if necessary, discharging the fabric treatment composition. For example, the reservoir may be provided in the form of an openable compartment into which may be placed a block or semi-permeable sachet of fabric treatment composition. Suitable materials for the reservoir include polypropylene.

Preferably the device is configured to present a smooth external profile when attached to a door or wall. This feature has the advantage that it prevents or at least can reduce the possibility of the device damaging the fabrics as they move through the dryer. It may not be important that the attachment part of the device is smooth, if this is not exposed when the device is fixed in place. In one embodiment the external profile is generally hemispherical.

The fabric treatment composition may be in the form of a liquid, solid or gel. The composition preferably comprises at least a perfume component and optionally water and may also comprise one or more perfume solubilisers. In this way the composition can act as a freshening composition.

Optionally the fabric treatment composition may also provide conditioning and/or other benefits to the fabrics inside the tumble dryer during a tumble drying cycle.

Suitable perfume solubilisers include surfactants, particularly nonionic surfactants such as alcohol ethoxylates, but also anionic, cationic, zwitterionic or amphoteric surfactants which may be used either alone or in combination with each other or with nonionic surfactants.

Other suitable perfume solubilisers include semi-polar solvents such as dipropylene glycol, butyl digol, polyethylene glycol, propylene glycol monobutyl ether and combinations thereof.

However, it is also possible to use soluble (e.g. water soluble) perfume in the fabric treatment composition, in which case it may not be necessary to use a perfume solubiliser.

Optional ingredients in the fabric treatment composition (which may provide conditioning or other benefits) include:

Antistatic Agents e.g. surfactants, particularly cationic, phosphate esters, silicones, polymers Garment Care Agents Softening agents e.g. cationic, Quaternary salts, particularly Di long chain ester quats, nonionics, fatty acids, alcohols and amines, clays.

Shape retention e.g. thermoplastic elastomers, (e.g. PMMA—polymethylmethacrylic acid), cationic, quaternary salts, polymers, cross-linked polymers.

Easy Iron Agents

Anti wrinkle agents e.g. silicones, polyolefin dispersions, starch, hydrophilic polymers, cross-linked polymers Iron glide agents e.g. silicones, ester oils, hydrocarbons, lubricants Dispersing aids: e.g. organic compounds: fatty acids and fatty acid soaps, polyethylene glycols and esters of polyethylene glycol, fatty alcohols and fatty esters, particularly fatty esters of sorbitol among others. Some classes of inorganic compounds that can be used are clays such as the smectites and bentonites and colloidal silicas such as cab-o-sil (tradename).

Improved Cleaning Performance Agents

Anti redeposition agents e.g. SCMC (sodium carboxymethylcellulose), PVP (polyvinyl pyrrolidone, PET/POET (polyethylene terephthalate/polyoxyethylene terephthalate (e.g. Aquaperle)

Soil/stain agents release e.g. Cellulose ethers, SCMC, Fluorocarbons

Fluorescers e.g. Tinopal DMS-X-Tinopal CBS-X

Faster drying agents e.g. amino-silicones, hydrogels, organic solvents, vapour pressure modifiers (e.g. alcohols and poly-alcohols)

Colour Care Agents

Reduced fibrilation agents e.g. quaternary salts, cationic polymers, cellulosic polymers enzymes (e.g. cellulose type)

Anti Dye transfer agents e.g. PVP, PVI (polyvinyl imidazoline), PVP-NO (polyvinyl pyridine-N-oxide Dye fixers e.g. amino functional polymers, polymeric quats, metal ions Anti ash agents e.g. polyacrilates, sequestrants (e.g. EDTA (Ethylene diamine tetra-acetic acid), EDDS (ethylene diamine disuccinic acid), EHDP (ethane 1-hydroxy,1,1-diphosphonic acid))

UV absorbants e.g. Parsol MCX, Uvinul, Tinuvin 871

Sequestrants e.g. heavy metals sequestrants (e.g. Copper), Dequest 2047, EDDS

Chlorine scavengers e.g. ammonium salts, thiosulfate

Hygiene Agents

Antibacterials/antifungals e.g. Triclosan, Diclosan, TCC (trichlorocarbanilide)

Antioxidants e.g. BHT (butylated hydroxytoluene), Vitamin C, Vitamin E

Odour Neutralization e.g. cyclodextrins, deo perfumes, activated charcoal, bicarbonate, zeolites, vermiculites Perfume enhancers e.g. cyclodextrins, mineral oils, ester oils, silicones.

Machine Care Agents

Corrosion inhibitors e.g. silicates, BTA (Benzotriazole), lubricants

Skin Care Agents

Moisturising/Humectants ingredients e.g. silicones, ester oils, glycerol, polyols, urea, cationic polymers Ancillary Ingredients Preservatives e.g. Kathon, BIT (1,2-benzisothiazolin-3-one), Miacide, Benzyl Alcohol, Phenoxyetol, Parabens, Glydant Thickening polymers or agents, and in particular: viscosity modifiers e.g. Polyacrilates, Carbomer, Cellulose ethers, CMC (carboxymethyl cellulose), Xantham Gum, Guar Gums, electrolytes Hydrotropes e.g. ethanol, IPA (isopropyl alcohol), Propylene Glycol DPG (dipropylene glycol), Glycerol, SXS (sodium xylene sulphonate), SCS (sodium cumene sulphonate), urea Solvents e.g. alcohols, Polyols, hydrocarbons, ethers, esters.

The means to expose the fabric treatment composition may comprise a transfer member. This may be a part of the device body and/or reservoir. As used herein, the term transfer member, should be construed as including any structure acting to actively or passively transfer the composition from the reservoir so as to be exposed to the air in the dryer or for direct contact with the fabrics in the dryer. The transfer member may, for example, comprise a membrane, or a layer of e.g. semi permeable material/s but is not intended to be restricted to a thin skin. For instance, the member may comprise foam material/s of any given thickness. The transfer member may comprise a composite structure of discrete layers/portions the one or more of the layers/portions may perform different functions, e.g. there may be a thick foam layer with a relatively large pore size and this is attached to (so as to strengthen) a second thinner, weaker material, having a relatively small pore size.

The transfer member may be fixed in position around its perimeter and preferably has an effective area of 500–2500 mm.

The reservoir may be removable from a housing or body portion which includes a membrane portion in fluid connection with the reservoir. Such fluid connection may be effected by a connecting channel or duct.

The fluid connection preferably includes an inlet port or channel for receiving a predetermined amount of the composition from the reservoir sufficient for a predetermined number of cycles at a given temperature, time and load size and may further include a charging port or channel or recess situated directly behind the membrane for continuous feed or charging of the membrane.

The means to expose the fabric treatment composition may simply comprise one or more openings in the reservoir e.g. a single opening, for example in the case where the reservoir is provided in the form of a disposable plastic cup with a peelable lid having a solid fabric treatment composition situated therein. In this case the reservoir is attached to the inside of the tumble dryer door and the lid peeled off to expose the solid fabric treatment composition therein. It may be desirable in this case to provide some form of restraining means, for example in the form of a grid or mesh over the fabric treatment composition to prevent the solid product falling out of the reservoir in use.

Alternatively, the reservoir may have a number of openings through which the fabric treatment composition can be viewed. For example, the reservoir may be constructed in the form of a cage with multiple slotted apertures in at least one surface of reservoir to allow airflow into and out of the reservoir. In this case the reservoir may be designed to be re-used on a number of occasions and has an openable and reclosable portion through which the fabric treatment composition can be charged and discharged to the reservoir.

In further embodiments of the invention, the at least one opening in the reservoir may comprise a multiplicity of very small openings, as in the case where a portion of the reservoir is provided with a semi-permeable membrane through which the fabric composition can migrate to contact air flowing against the external surface of the membrane. Suitable semi-permeable materials include Goretex™ and Accurel™. Other semi-permeable materials include open cell foams, pumice, sintered materials etc. Alternatively, a wall of the reservoir may comprise a series of capillary holes.

The transfer of fabric treatment composition to the fabrics in the tumble drier may be effected solely by airflow generated in the tumble drier. Depending upon the model of the tumble drier and program setting temperatures of up to 100° C. with wet clothes may be generated within the tumble drier, generally in the range 30° C. to 80° C. for most drying cycles (the hot air generated by the heater in the tumble drier may be as high as 150° C., generally 110° C. to 120° C.). In addition, the means to expose the fabric treatment composition may be constricted and arranged such that there may be direct contact between fabric in the tumble drier and the exposed fabric treatment composition in order to facilitate transfer of fabric treatment composition to the fabric.

In an alternative embodiment of the invention the wall of the reservoir is provided with at least one opening which is substantially closed by a retained rotatable sphere whereby fabric treatment composition from the reservoir contacts the surface of the sphere which may rotate to expose fabric treatment composition to warm air generated inside the tumble drier and/or to direct contact by fabrics. The retained sphere acts in an analogous manner to a ball point pen or roller-ball deodorant dispenser. Rotation of the sphere within the tumble drier may take place by the vibration of the machine and/or contact with the tumbling garments.

The reservoir may hold sufficient fabric composition for any number of drying cycles and for instance the reservoir may hold sufficient composition for a single cycle. With this arrangement, different compositions could be used for different drying cycles allowing great flexibility for the user.

The reservoir of the device of the invention may alternatively or additionally be capable of holding sufficient fabric treatment composition for a plurality of drying cycles of the tumble drier. In this case, the reservoir preferably holds sufficient composition for at least six, preferably at least ten drying cycles, more preferably at least twenty cycles, of the tumble drier. The device may comprise means for dispensing a unit dose of fabric composition from the reservoir at or before the start of the drying cycle which is sufficient to provide the required amount of fabric treatment composition during the drying cycle. The reservoir may be divided into a plurality of cavities or compartments each containing fabric composition, the contents of each cavity may be sequentially transferred to the means to expose the fabric composition or may simply be sequentially exposed to the warm air in the tumble drier e.g. by removing a lid.

In a further embodiment of the invention the device comprises means for urging fabric composition inside the reservoir towards the means to expose the fabric treatment composition. The means to urge the composition preferably comprises a pump which may dispense fabric treatment composition from the reservoir to a sponge or a separate compartment having a membrane, slot or capillary holes through which the fabric treatment composition may pass thereby becoming exposed to hot air within the tumble drier. In such embodiments the user simply operates the pump, which may have a simple push action, to recharge the exposure means at the start of a drying cycle. If desired, a non-return valve may be disposed between the pump and the exposure means.

The means for attaching the device to the inside of the tumble dryer door may comprise adhesive means, for example in the form of an adhesive pad situated on one surface of the reservoir. Alternatively, suction means may be used in the form of, for example, a suction pad. Other suitable attachment means include hooks, claws and Velcro™. It may be desirable to provide more than one different type of attachment means on the device for versatility in different tumble dryer environments. For example a sucker form of attachment would be suitable for attaching the device to the glass/plastic/metal door of a conventional tumble dryer (usually with an external vent). However, many modern tumble dryers have a number of small holes in the inside of the door to allow moisture out of the tumble dryer drum to condense in a tray below or vented to the outside of the machine. In this case, a hook or claw attachment on the device may be more suitable. However, it is not always the case that condenser machines require a hook-type faster and vented machines require a sucker. Some condenser machines are configured such that a sucker works better, and vice versa.

There are other ways of attaching the device to the door, eg by a magnet, by a bayonet clip, by glue, by extendable arms which may have a raw plug configuration. The device may include a mounting bracket/frame for attachment to the dryer door, to which the device body is then attached.

The means for indicating to the user when the fabric treatment composition is used up preferably comprises visible indicia associated with the device. In one embodiment of the invention, the user is able simply to inspect the quantity of fabric treatment composition remaining in the device by looking through the at least one opening of the reservoir to the composition therein. Alternatively, the fabric treatment composition may be impregnated in a solid substrate which gives an appearance change, for example changes colour, when all the fabric treatment composition has been used up. In another embodiment of the invention, the reservoir may be formed from a transparent or translucent material to allow visual inspection of the quantity of fabric treatment composition inside the reservoir.

When the reservoir of the device is formed from flexible material, the device may further be provided with one or more resilient or sprung members mounted on the device and disposed to engage the reservoir in use and urge the contents of the reservoir towards the at least one opening therein.

The device of the invention may further comprise a flow controller to allow the user to regulate the quantity of fabric treatment composition contacted by the warm air in the tumble dryer during a tumble drying cycle.

In addition, according to the invention there is provided a method of treating fabrics in a tumble dryer during multiple tumble drying cycles comprising attaching a device according to the invention to the inside of a tumble dryer door and carrying out a tumble drying process with fabrics inside the tumble dryer.

Further provided in accordance with the invention is a tumble dryer with a device according to the invention attached therein.

The invention will now be more particularly described with reference to the following figures in which.

Figure 1:
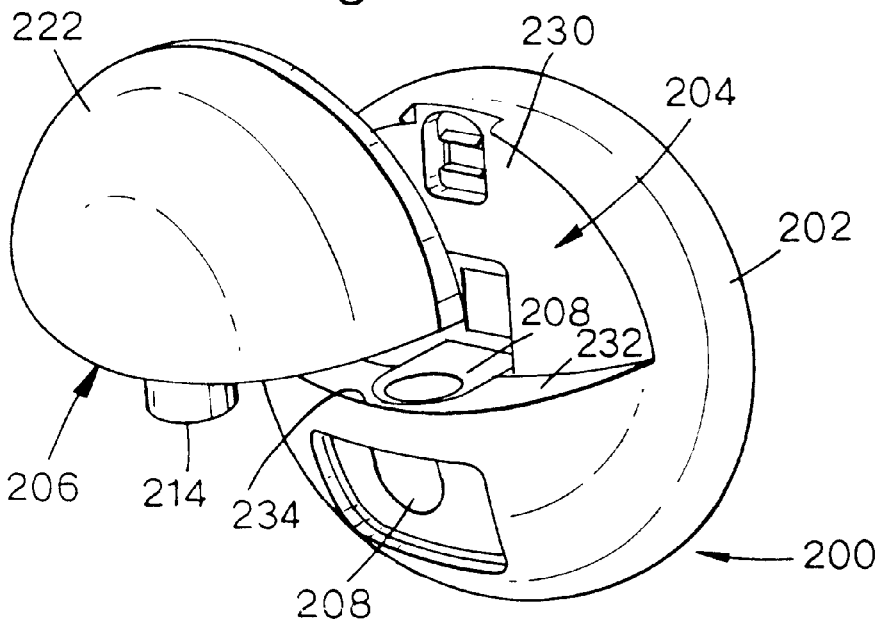
FIG. 1 is a schematic diagram of a first device according to the invention.
Figure 5:
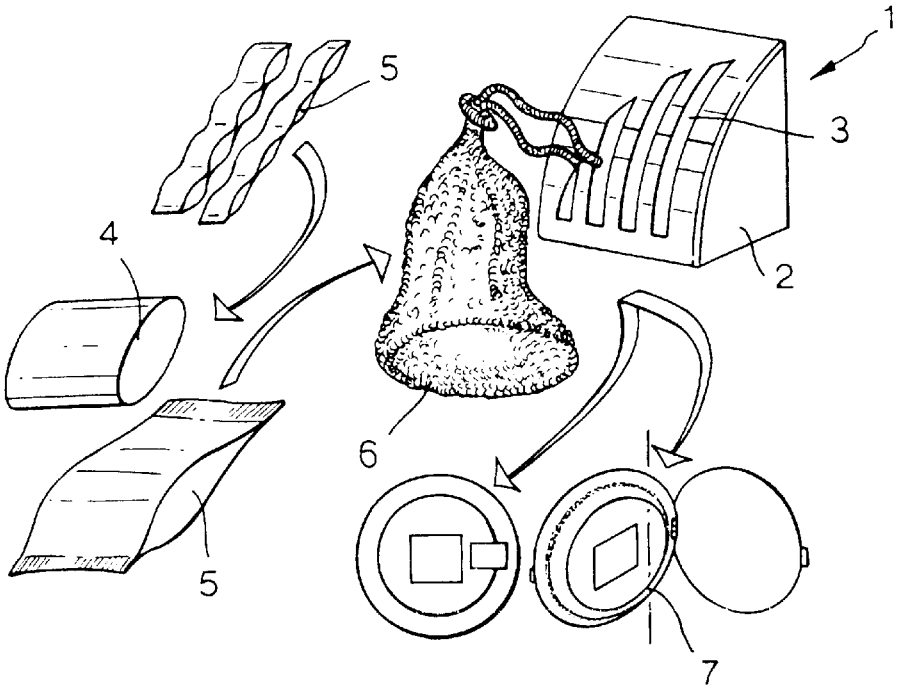
Figure 6:
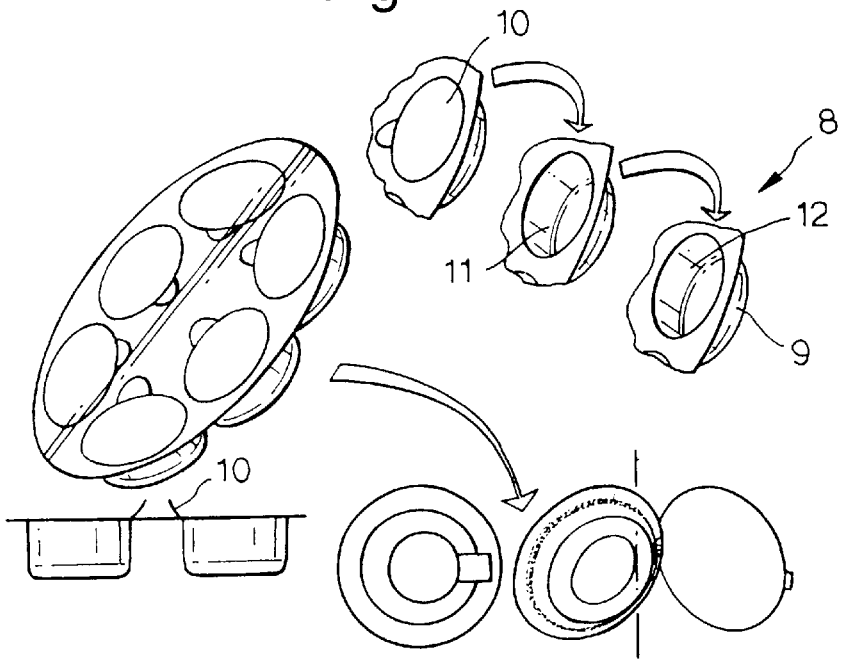
Figure 7:
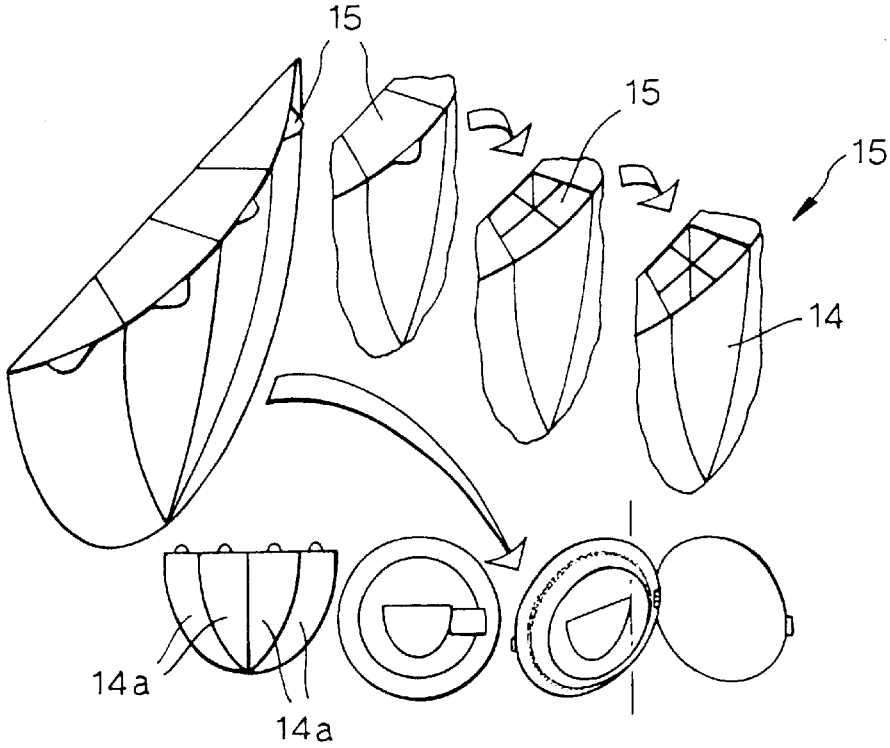
Figure 8:
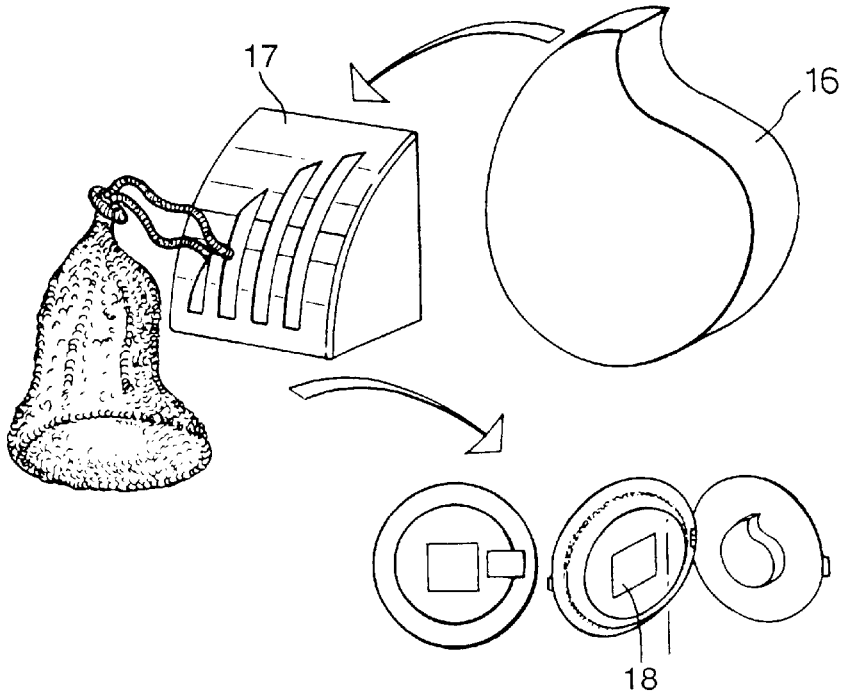
Figure 9:
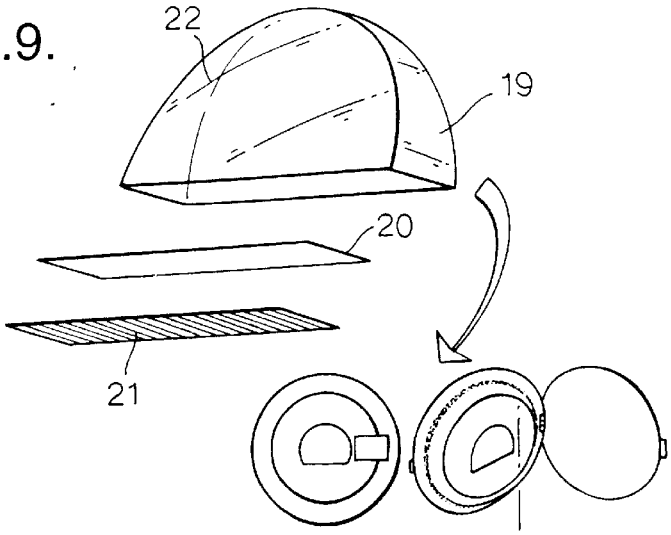
Figure 13:
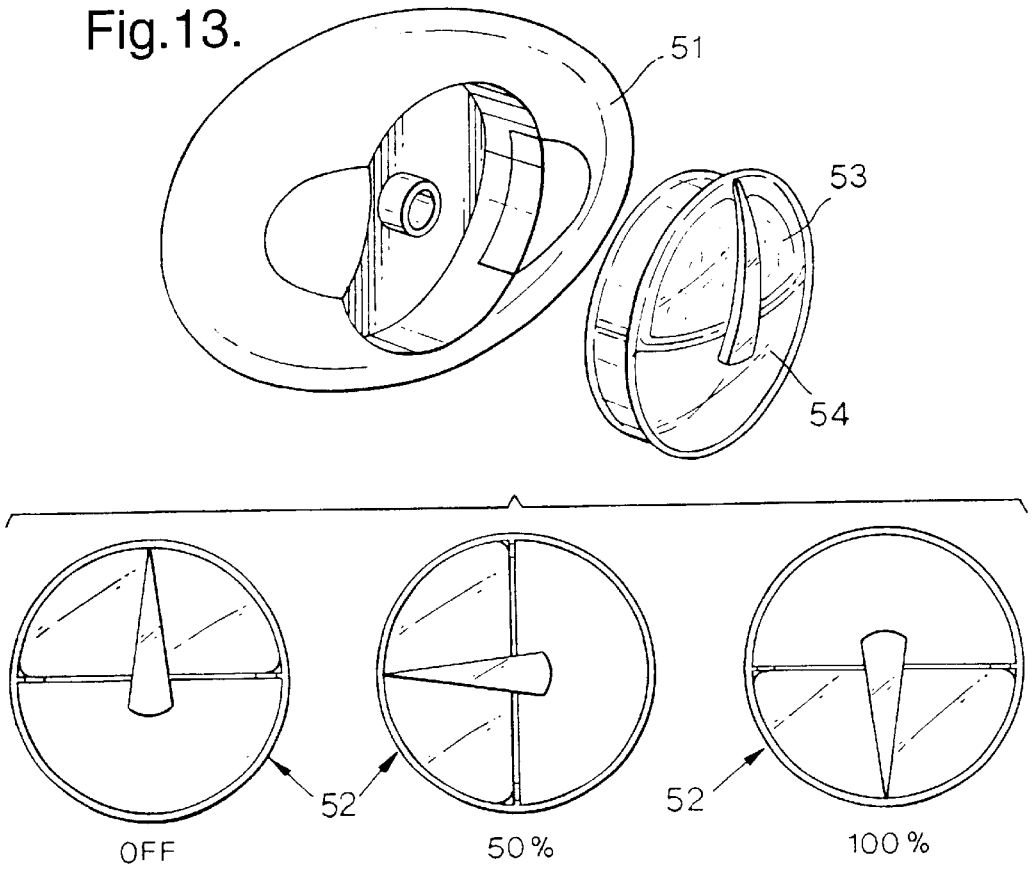
Figure 10:
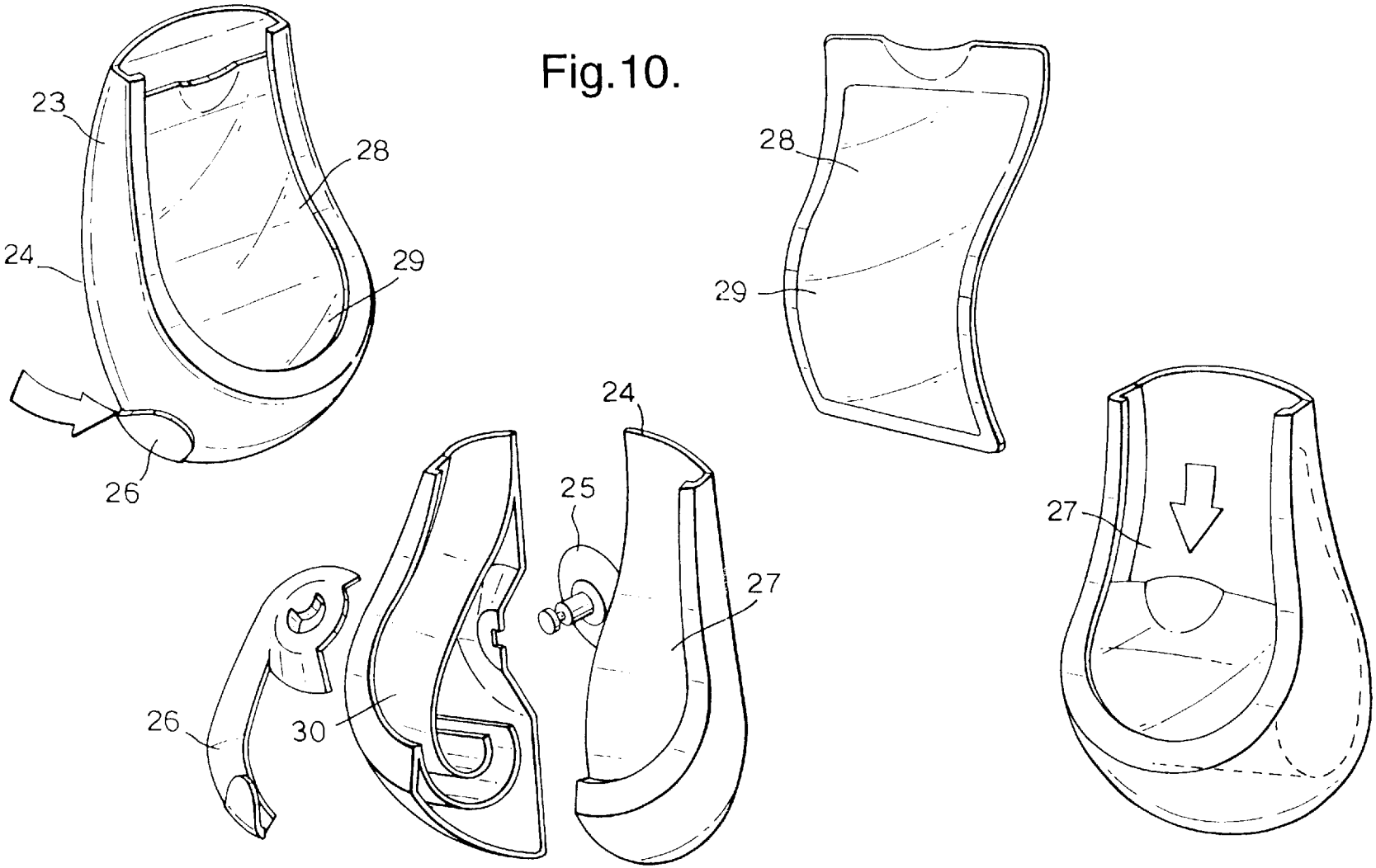
Figure 11:
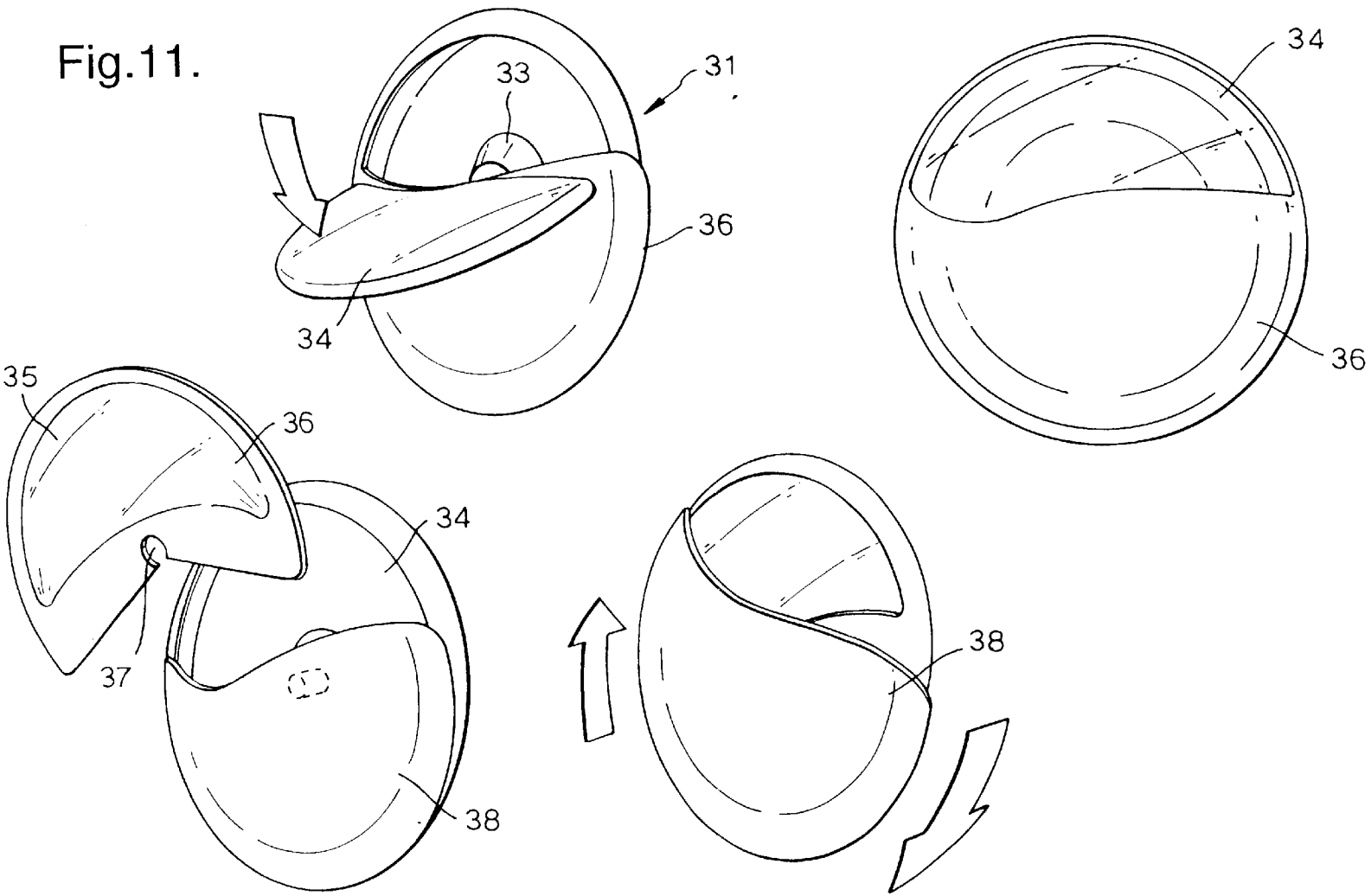
Figure 12:
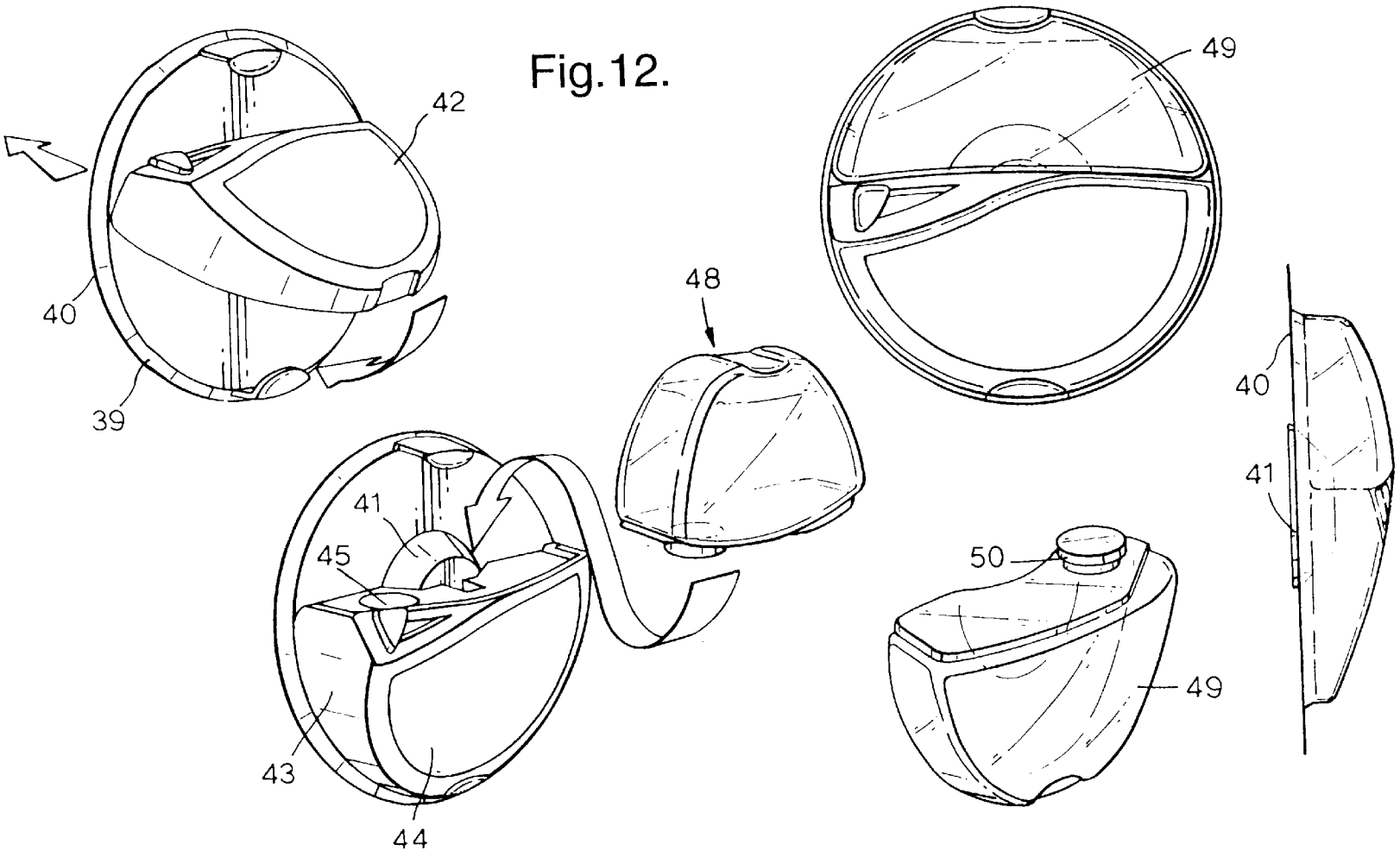
Figure 14:
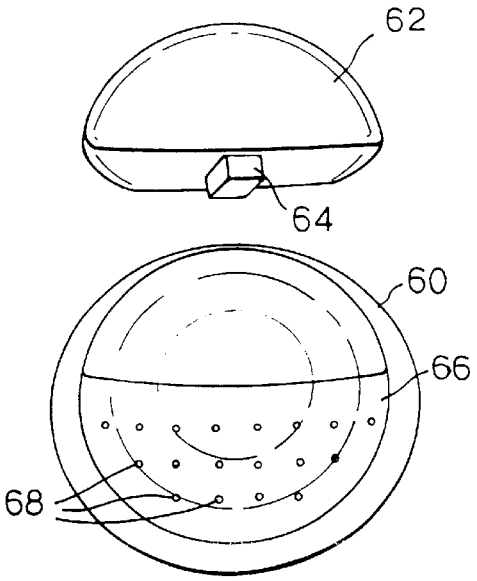
Figure 15:
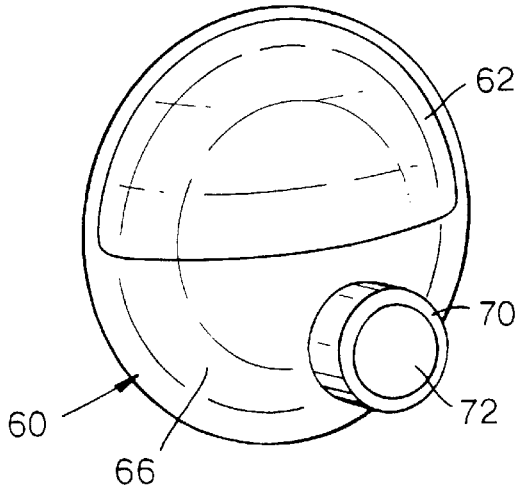
Figure 16:
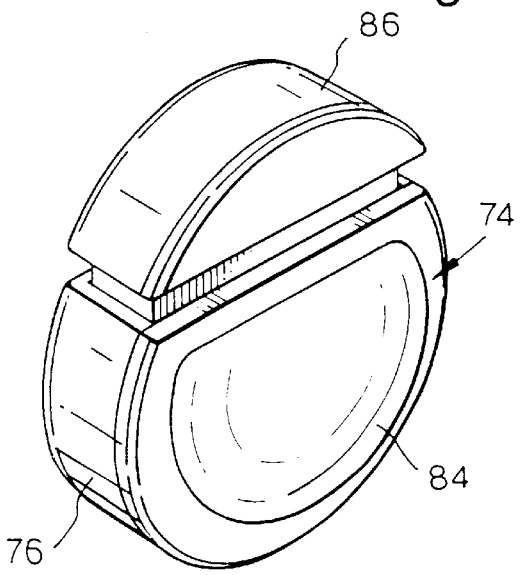
Figure 16:
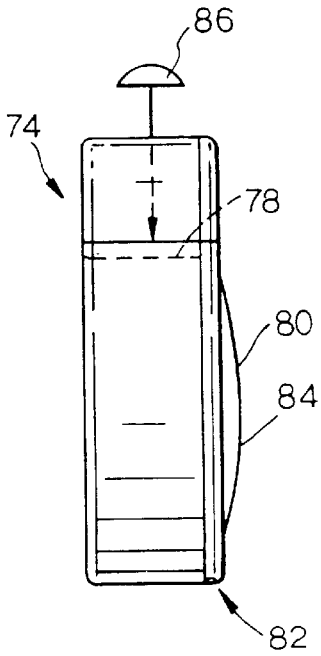
Figure 17:
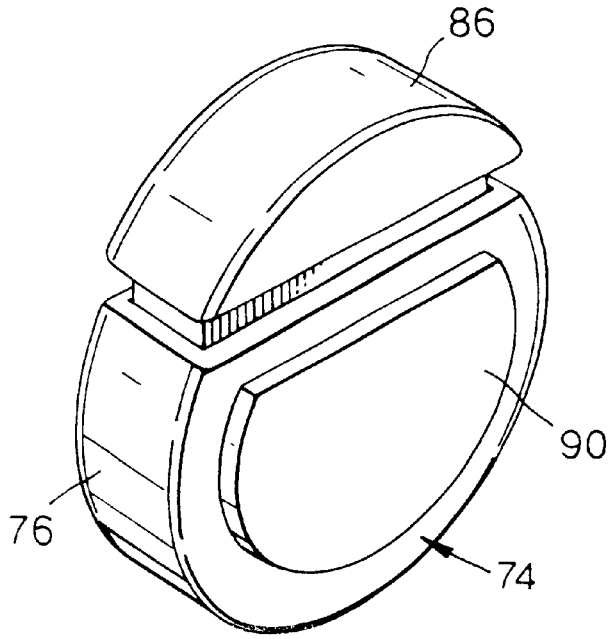
Figure 17:
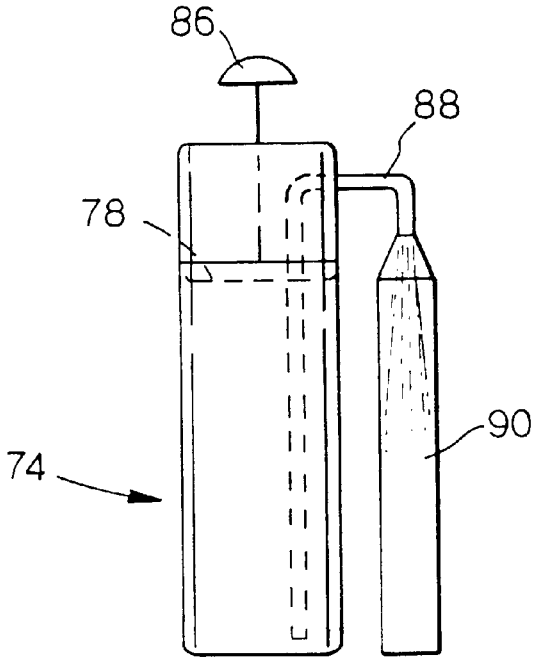

FIGS. 4*a*–4*d* are schematic diagrams showing further views of the device of FIG. 1;

FIG. 5 is a schematic diagram of a third device according to the invention;

FIG. 6 is a schematic diagram of a fourth device according to the invention;

FIG. 7 is a schematic diagram of a fifth device according to the invention;

FIG. 8 is a schematic diagram of a sixth device according to the invention;

FIG. 9 is a schematic diagram of a seventh device according to the invention;

FIG. 10 is a schematic diagram of a eighth device according to the invention;

FIG. 11 is a schematic diagram of an ninth device according to the invention;

FIG. 12 is a schematic diagram of a tenth device according to the invention;

FIG. 13 is a schematic diagram of a eleventh device according to the invention;

FIG. 14 is a schematic diagram of an twelfth device according to the invention;

FIG. 15 is a schematic diagram of a thirteenth device according to the invention;

FIG. 16 is a schematic diagram of a fourteenth device according to the invention; and FIG. 17 is a schematic diagram of a fifteenth device according to the invention.

Figure 18:
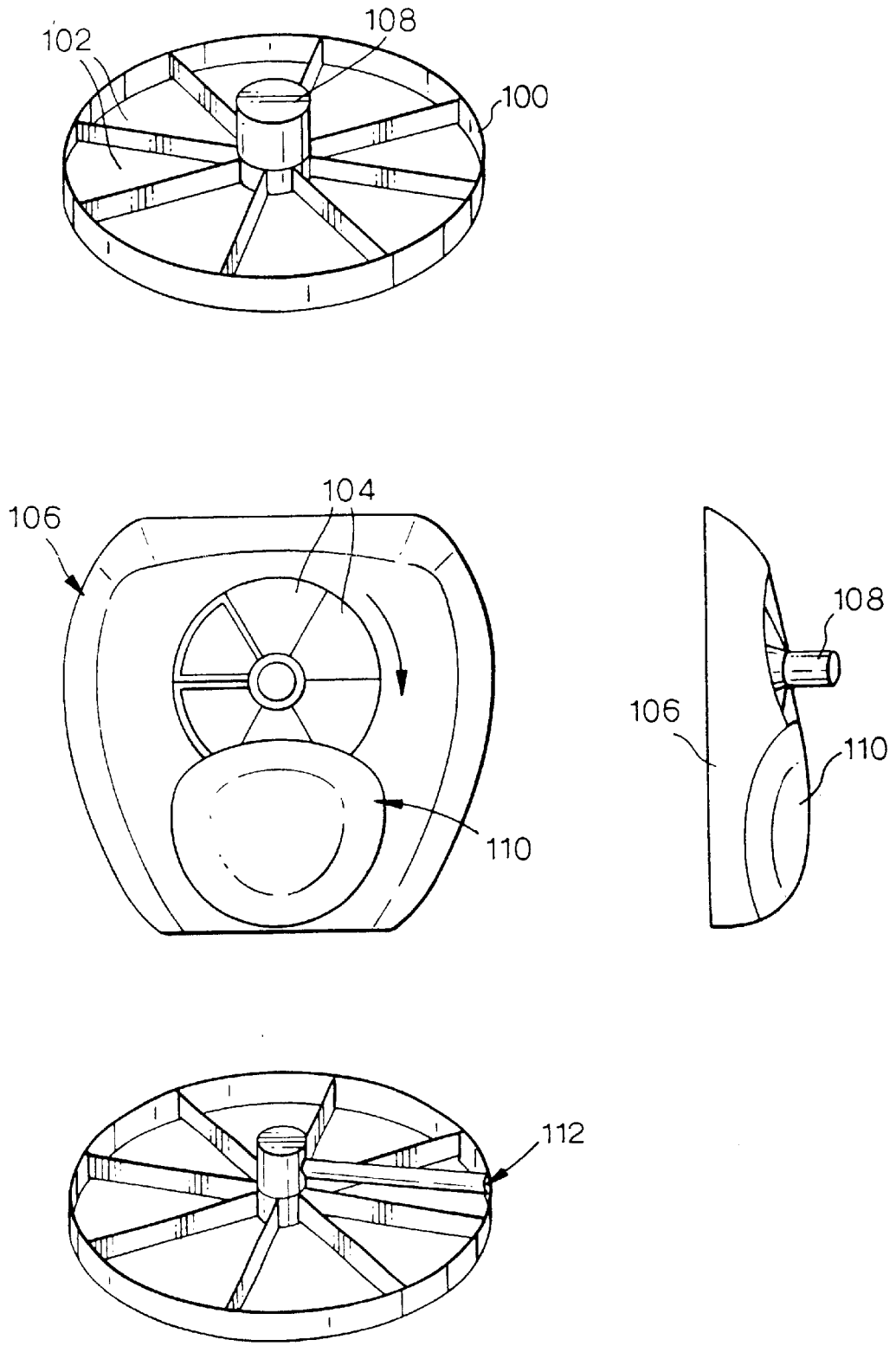

FIG. 18 is a schematic diagram of a sixteenth device according to the invention.

FIG. 1 illustrates device 200 (shown orientated upright and viewed from the front) comprising a rigid dome shaped body 202 with a reservoir recess 204 configured for snap-fit receipt of a removable reservoir 206. The reservoir recess 204 constitutes a major part of the upper half of the body (when orientated upright).

The device 200 also includes a chamber or inlet port 208, having a capacity to hold a predetermined volume of fluid freshener, which is, in this embodiment 1.5 ml and is sufficient for one drying cycle of 1 hour at 60 degrees C. However, the inlet port may have a volume sufficient for any number of cycles. The port 208 is located beneath (when the device is held oriented as it would be when attached to the dryer door) and in fluid communication with the reservoir recess 204 to allow liquid to enter the port 208 from the reservoir 206 when it is in place in the recess 204.

The reservoir 206 comprises a polypropylene bottle with body portion and neck portion 214. The body portion is defined by three main generally crescent shaped faces: a front face 222 and a rear face 224 and a shoulder face 226. The front and rear faces 222, 224, extend from opposed edges of the shoulder face 226 and depend therefrom to meet at a common curved edge 228. The radius of curvature of the rear face 224 is less than that of the front face 222.

The reservoir recess 204, has a curved back wall 230, base wall 232 and top wall or lip 234 which correspond in shape with the rear face 222 shoulder face 226 and edge 228 respectively so that the reservoir is retained in the recess by the walls 230, 232 and 234 and by the retaining overhanging edges of 202 and by the engagement of the neck portion 214 with the port 208. The neck is configured for engagement with the inlet port 208, taking into account of any seals: The inlet port 208 may include an annular resilient seal 216 of a thermoplastic elastomer (TPE) to ensure leak proof engagement of the reservoir 206 with the port 208.

The reservoir preferably has a pin-hole (not shown) in the edge region 228 or front face 222 or back surface 224 so that as fluid freshener leaves the bottle it can be replaced with air, gradually, so as not to interfere with the gradual flow of the fluid to the membrane. This has the advantage of ensuring consistency in delivery of composition.

Insertion and removal is aided by limited flexibility of the refill bottle and device body such that snap-fit installation and removal can be effected even with the device attached to the dryer door, (attachment is explained below).

The rear of the device is recessed and contains a sucker 240 (shown only in FIG. 4) for attaching the (or even adjacent wall) of e.g. conventional dryers and a hook 242 for attachment to the tumble dryer door of e.g. condenser dryers (which have slots or holes in the door). One possible hook shape is shown (at 242) in FIG. 4*a* and comprises an elongate arm which is pivotable about a pivot 244 through about 90 degrees, between a position in which the hook 242 is enclosed within the rear recess and an attachment position in which it projects from the device. The hook is curved only where it connects with the device—it is straight at the opposite end, as the gentle curve blocks the removal of the machine filter in some machines, so needs to be removed from the design for such machines.

The device shown further includes a transfer member comprising a membrane 210 of polypropylene. In one embodiment this has with a thickness of 160 microns and a pore size of 0.2 microns. However other thickness/pore size values may be used, the appropriate pore size and thickness of the membrane varying depending on the fabric treatment composition viscosity, and the delivery rate required.

Figure 2:
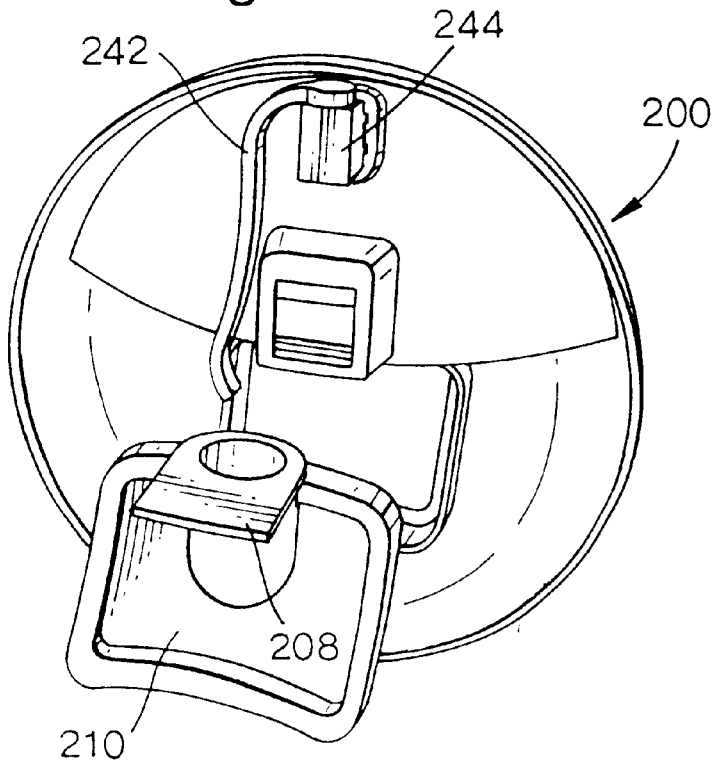
FIG. 2 is a schematic diagram showing the rear of an alternative device according to the invention
Figure 3A:
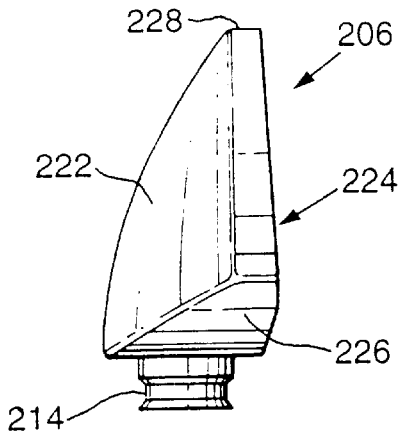
FIGS. 3*a*–3*g* are schematic diagrams showing different views of the reservoir shown removed from the device of FIG. 1.
Figure 3B:
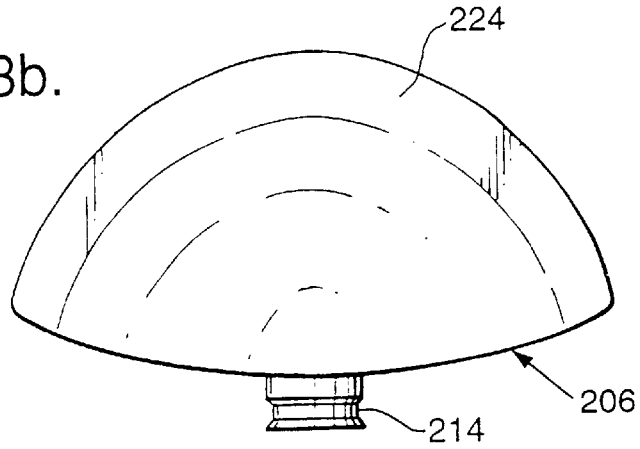
Figure 3C:
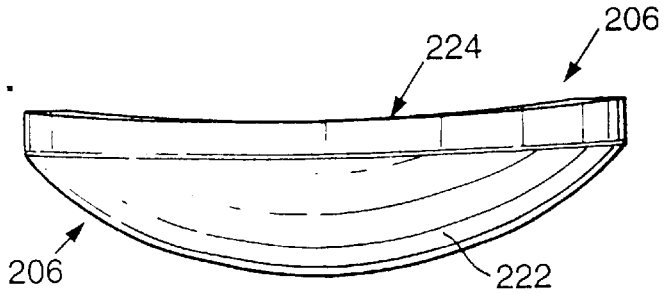
Figure 3D:
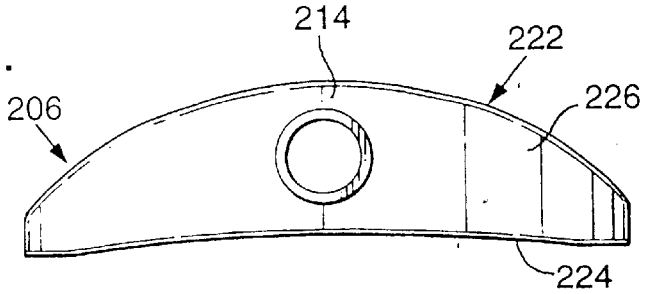
Figure 3E:
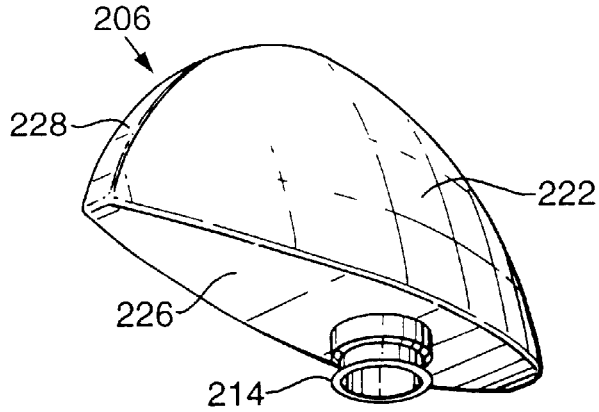
Figure 3F:
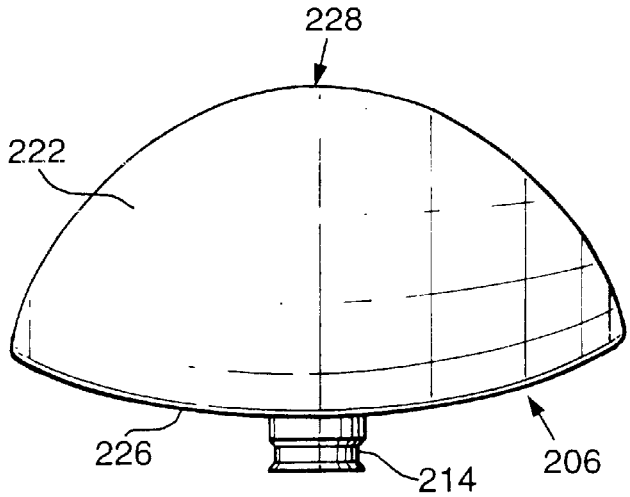
Figure 3G:
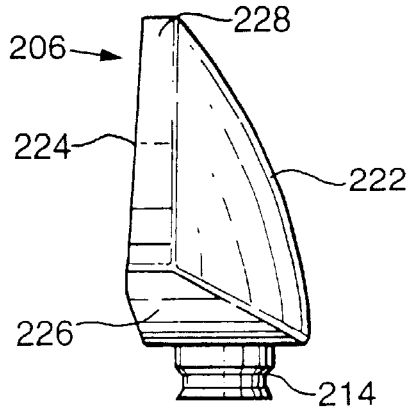
Figure 4A:
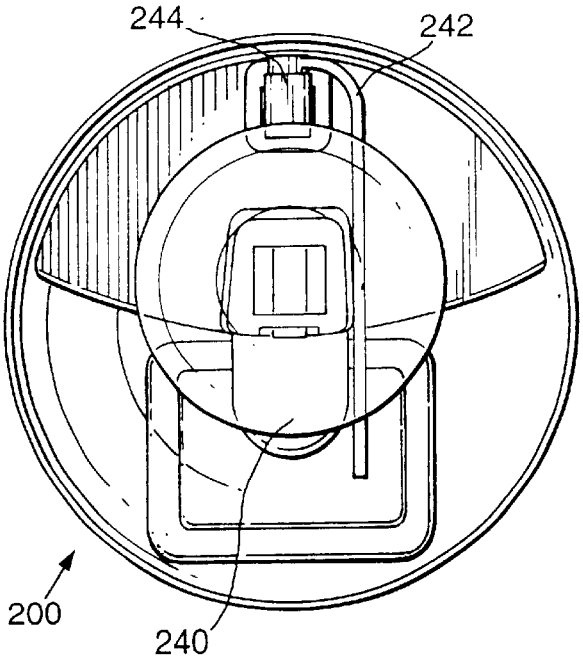
Figure 4B:
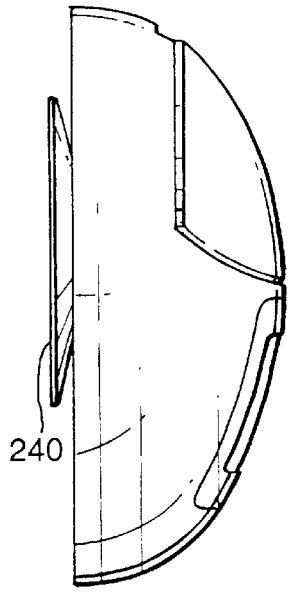
Figure 4C:
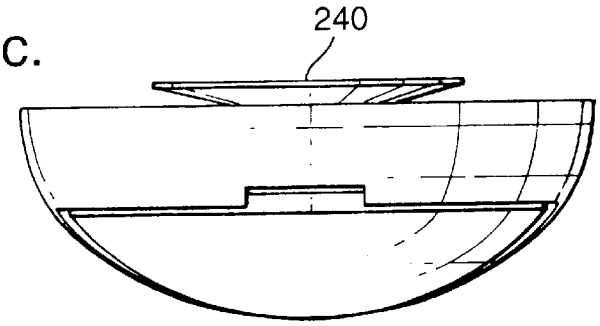
Figure 4D:
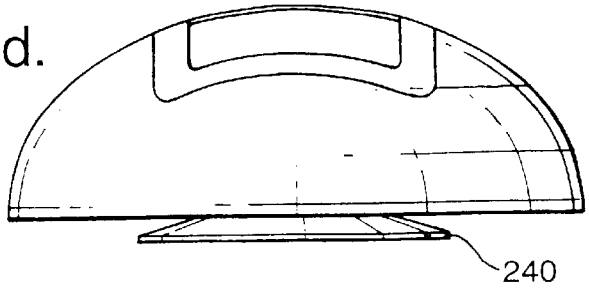

This membrane is fixed around its perimeter preferably by ultrasonic welds and preferably, to enable a better seal (for the purpose of preventing leaking of the fabric treatment composition), by a substantially continuous weld, to a window frame 212. Optionally, the inlet port 208, is integral with the window frame, again, to enable a leak proof system. The manufacture of the framed membrane involves melting upstanding ribs on the frame by ultrasonic welding so as to weld these to the perimeter of the membrane. The framed membrane 210 is attached to the device body 202 (by the ultrasonic welding which is done with the port/frame/membrane in situ in the device body 202). The area inside of the welded perimeter provides the effective membrane area that is to say the active part of the transfer member (in this example a membrane). In the embodiments shown in FIGS. 1 and 2, the area is 40×27 mm=1080 $mm^2$. Another embodiments (not shown) may have has larger area of 50×27 mm=1350 $mm^2$, or larger still, Such as 80×30=2400 $mm^2$. Preferably the effective part of the transfer member has an area in the range 500–5000 $mm^2$. Behind the membrane is a recess of corresponding shape which has a slightly projecting perimeter region for attachment of the membrane frame thereto, so that a gap is defined between the membrane and the recess wall. In this narrow gap approximately 2–3 mm, a small amount of freshener fluid can collect to 'charge' or 'feed' the membrane continuously without causing leakages.

It is important to prevent leakage of the fabric treatment composition, as this can lead to staining of fabrics.

In use the reservoir is disposed with the neck pointing downwards, engaging the inlet port so that fluid from the reservoir flows, under gravity to the port and then to the membrane from where it evaporates/transfers in the dryer.

The fabric treatment composition may take any suitable form, for example it may be as described in any of the following embodiments (e.g. solid, liquid, gel at room temperature).

Referring to the remaining figures, other embodiments of the invention are shown.

FIG. 5, there is provided a reservoir 1 of rigid plastic material comprising a wedge shaped container 2 with slotted apertures 3 in its curved surface to allow warm air into and out of the reservoir 1. The fabric treatment composition may be provided in the form of a solid block 4 or semi-permeable sachet(s) 5 of liquid material and placed inside the reservoir 1, optionally inside a net bag 6. The reservoir is then affixed to the inside of a tumble dryer door 7 as shown in FIG. 1.

Referring to FIG. 6, the reservoir 8 is provided in the form of a rigid pot 9 having a peelable lid 10. The fabric composition is a solid block 11 situated inside the pot and retained in place by restraining bars 12 across the main opening of the pot 9.

Referring to FIG. 7, the reservoir 13 is shown as a rigid plastic container 14 having a plurality of compartments 14*a* comprising a liquid fabric treatment composition 15. Each compartment has a peelable lid 15*a* which is removed to expose the composition 15.

Referring to FIG. 8, the fabric treatment composition is dosed inside an absorbent sponge 16 which is placed inside the reservoir 17 prior to affixation to the tumble dryer door 18.

FIG. 9 shows a rigid reservoir 19 comprising a membrane base 20 and wick base 21 inside which a liquid fabric treatment composition 22 is located. In this case the reservoir 19 is formed from a transparent or translucent material to provide a visible indication to the user when the fabric treatment composition 22 is used up.

FIG. 10 shows a device 23 provided on its distal surface 24 with sucker attachment means 25 actuated by lever 26 mounted on the side of device 23. Device 23 comprises a compartment 27 for receiving a sachet 28 of fabric composition. Sachet 28 has a semi permeable membrane portion 29 on one surface thereof. Sachet 28 slots into compartment 27 and the contents of the sachet are urged towards semi permeable membrane portion 29 by resilient member 30. Sachet 28 is of translucent material to provide visual indicia for determining when the fabric treatment composition is used up and needs replacing. The quantity of fabric treatment composition available for contact with airflow in the tumble dryer can be controlled by the user by adjusting the position of sachet 28 in compartment 27. Pushing flexible sachet 28 downwardly causes the sachet to wrap around the back of resilient member 30, thus removing any wrapped around portion of sachet 28 from contact with warm air in use.

FIG. 11 shows a device 31 provided on its distal surface 32 with sucker attachment means 33 actuated by lever 34 mounted on the front of device 31. Device 31 comprises a compartment 34 for receiving a sachet 35 of fabric treatment composition. Sachet 35 has a semi-permeable membrane portion 36 on one surface thereof. Sachet 35 slots into compartment 34 and is retained in place by clip 37 which engages with the stem of sucker attachment means 33. Sachet 35 is of translucent material to provide visual indicia for determining when the fabric treatment composition is used up and needs replacing. The quantity of fabric treatment composition available for contact with airflow in the tumble dryer can be controlled by the user by adjusting the position of rotatable sleeve 38 to cover a selected portion of sachet 35 from contact with airflow in use.

FIG. 12 shows a device 39 provided on its distal surface 40 with sucker attachment means 41 actuated by lever 42 mounted on the front of device 31. Device 39 comprises a reservoir 43 having two distinct portions. A first portion 44 comprises a hollow chamber inside lever 42 which has an inlet port 45 for a fabric treatment composition, a semi-permeable membrane portion 46 to allow fabric treatment composition inside reservoir portion 44 to migrate into contact with airflow in the tumble dryer and flow control means 47 for controlling the size of the aperture of inlet port 45. A second portion 48 comprises a translucent container 49 having an outlet port 50 engageable with inlet port 45 of first portion 44. Second portion 48 contains a liquid fabric treatment composition and is replaceable when the composition is exhausted.

FIG. 13 shows a device 51 having a snap-in reservoir 52 with a semi-permeable membrane portion 53 and a chamber portion 54 separated by a wick. Flow control is achieved by rotating the reservoir in device 51.

FIG. 14 illustrates an exploded view of a further device in accordance with the invention. The device comprises a holder 60 which is secured to the door of a tumble drier by an attachment means (not shown) e.g. adhesive pad, suction pad etc. A reservoir 62 has an outlet 64 and is shaped to engage within the body 60. Fabric treatment composition from the reservoir passes to a compartment 66 in the lower half of the body 60. The compartment 66 has an outer wall comprising a plurality of capillary holes 68 through which the fabric treatment composition passes thereby being exposed to airflow and contact with fabric within the tumble drier. The device may be constructed of transparent plastics material so that the contents may be readily viewed and the reservoir replaced or replenished when the device is empty.

In a further embodiment of the invention (not shown) the capillary holes in the wall of the compartment 66 are replaced by a sintered material allowing fabric treatment composition to pass therethrough.

The device illustrated in FIG. 15 is similar to the device of FIG. 14 with the exception that the capillary holes are replaced by an outlet 70 having a retained, rotatable sphere 72. Fabric freshener composition passes from the reservoir 62 in to the compartment 66 where it contacts the surface of the sphere 72. Rotation of the sphere 72 by vibration or contact with tumbling garments exposes fabric treatment composition to the airflow generated in the tumble drier.

FIG. 16 illustrates a device 74 comprising a reservoir 76 containing fabric treatment composition 78 and a dispensing compartment separate from the reservoir 76 but in communication therewith via a constriction or non-return valve 82. The dispensing compartment 80 has an outer wall comprising a semi-permeable membrane 84. The reservoir is provided with a pump 86 shown schematically. In operation, the pump 86 is operated by pressing downwardly causing fabric treatment composition 78 from the reservoir 76 to pass through the non-return valve 82 in to the dispensing compartment 80. The fabric treatment composition passes slowly through the membrane 84 and is exposed to airflow within the tumble drier. The membrane 84 is flexible and will bulge to a dome shape when fabric treatment composition is pumped in to the compartment 80.

FIG. 17 illustrates a device in accordance with the invention similar to that exposed in FIG. 16 and like parts are shown with like reference numerals. In the device of FIG. 17 the fabric treatment composition 78 is pumped from the reservoir 76 via a conduit 88 to a sponge or foam pad 90. The pad 90 is saturated with fabric treatment composition thereby exposing the composition to airflow generated in the tumble drier.

FIG. 18 illustrates a device in which the reservoir 100 comprises a plurality of compartments 102. The device illustrated has six components but the number may be readily altered. Each compartment 102 contains fabric treatment composition and each compartment is sealed with a lid e.g. film or metal foil 104. The reservoir is rotatably mounted in the body 106 of the device and has a protruding knob 108 to allow manual rotation thereof. The device has a sponge 110 to which each of the compartments 102 may be exposed upon rotation of the reservoir.

In use the reservoir is rotated causing a compartment 102 to become exposed to the sponge pad 110. Exposure may be achieved by the lid of a compartment being rolled back as shown generally at 112 or the lid may be punctured thereby allowing fabric freshener in the compartment 102 to come into contact with the sponge pad 110. The fabric freshener saturates the sponge pad 110 and becomes exposed to airflow generated within the tumble drier. When the fabric freshener from one compartment has been used the reservoir is rotated to expose the next compartment 102 to the sponge pad 110.

It is of course to be understood that the invention is not intended to be restricted to the details of the above embodiments which are described by way of example only.

What is claimed is:

1. A device for treating fabrics in a tumble dryer during multiple tumble drying cycles comprising: a reservoir for storing a fabric treatment composition means, a rigid body portion comprising an inlet port for transfer of the treatment composition from the reservoir to a transfer member, means to expose fabric treatment composition from the reservoir to airflow generated inside the tumble drier and/or to directly contact fabrics in the dryer, thereby transferring a portion of the fabric treatment component into contact with fabrics in the tumble dryer during a tumble drying cycle, wherein the means to expose fabric treatment composition from the reservoir includes the transfer member in fluid connection with the reservoir; and wherein the inlet port is interengageable with a portion of the reservoir, to allow transfer of the fabric treatment composition therebetween.

2. A device according to claim 1 wherein the fabric treatment composition has at least a perfume component.

3. A device according to claim 1 having the provision of attachment means for attaching the device to the inside of the tumble dryer door.

4. A device according to claim 1 wherein the device comprises a rigid body portion having the attachment means located thereon and a reservoir recess for receiving the reservoir.

5. A device according to claim 1 wherein the reservoir is replaceable when the fabric treatment composition is used up.

6. A device according to claim 1 wherein the reservoir is refillable when the fabric treatment composition is used up.

7. A device according to claim 1 wherein the inlet port is disposed directly behind the transfer member.

8. A device according to claim 1 wherein the inlet port is located centrally with respect to the transfer member.

9. A device according to claim 1 wherein the inlet port is dimensioned to contain a predetermined volume of treatment composition sufficient for a predetermined number of drying cycles.

10. A device according to claim 1 wherein the inlet port has a volume of 1.5 ml.

11. A device according to claim 1 wherein the transfer member is located so that a major area of the transfer member is spaced apart from the rigid body to define a gap there between.

12. A device according to claim 1 wherein the transfer member has a pore size in the range of 0.1–10 microns.

13. A device according to claim 1 wherein the transfer member comprises a polypropylene material.

14. A device according to any preceding claim 1 wherein the transfer member comprises a sinter material.

15. A device according to claim 1 wherein the transfer member comprises a woven material, such as polyester.

16. A device according to claim 1 wherein the transfer member comprises a semi-permeable material.

17. A device according to claim 1 wherein the transfer member comprises a foam material.

18. A device according to claim 1 wherein the transfer member comprises a membrane or semi-permeable material mounted on a resilient material such as foam or rubber.

19. A device according to claim 1 wherein the transfer member has an effective area of 500–5000 $mm^2$.

20. A device according to claim 1 wherein the transfer member has an effective area of 1080 $mm^2$.

21. A device according to claim 1 wherein the transfer member has an effective area of 1350 $mm^2$.

22. A device according to claim 1 wherein the transfer member has an effective area of 2400 $mm^2$.

23. A device according to claim 1 wherein the reservoir holds sufficient fabric treatment composition for one or a plurality of drying cycles of the tumble drier.

24. A device according to claim 23 wherein the reservoir holds sufficient fabric treatment composition for at least ten drying cycles, preferably about twenty cycles of the tumble drier.

25. A device according to claim 4 wherein the attachment means includes suction means.

26. A device according to claim 4 wherein the attachment means includes hook means.

27. A device according to claim 4 wherein the attachment means includes adhesive means.

28. A device according to claim 1 comprising means to indicate to a user when the fabric treatment composition is used up.

29. A device according to claim 28 wherein the contents of the reservoir are visible to the user when loading or unloading the tumble dryer to provide means for indicating to the user when the fabric treatment composition is used up.

30. A device according to claim 29 wherein the contents of the reservoir are visible through the at least one portion, e.g. opening thereof.

31. A device according to claim 29 wherein at least a portion of the reservoir is of transparent or translucent material.

32. A method of treating fabrics in a tumble dryer during multiple tumble drying cycles comprising attaching a device according to claim 1 to the inside of a tumble dryer door and carrying out a tumble drying process with fabrics inside the tumble dryer.

33. A method according to claim 32 in which the tumble drier is operated to achieve an elevated temperature of up to 100° C.

34. A method according to claim 33 in which the tumble drier is operated to achieve a temperature in the range 30° C. to 80° C.

35. A device according to claim 1, wherein the fabric treatment composition comprises a perfume.

36. A device according to claim 1, wherein the fabric treatment composition comprises a perfume and perfume solubiliser.

37. A device according to claim 1, wherein the fabric treatment composition comprises one or more further benefit agents.

38. A device according to claim 37 wherein the benefit agent is selected from antistatic agents, fabric softening agents, easy iron agents, stain release agents, colour care, u.v. absorbents, skin care agents, antibacterial agents and antioxidants, viscosity modifiers, dispersing aids, faster drying agents, perfume enhancers.

39. A device according to claim 1 wherein the fabric treatment composition is solid at room temperature and pressure.

40. A device according to claim 1 wherein the fabric treatment composition is liquid at room temperature and pressure.

41. A device according to claim 1 wherein the fabric treatment composition is a gel at room temperature and pressure.

42. A device according to claim 1 wherein the reservoir has a hole which is located so as to allow air into the reservoir as fabric treatment composition is used up.

43. A device according to claim 1 characterised in that the external profile of the device is generally hemispherical.

44. A tumble dryer with a device according to claim 1 attached therein.

45. A reservoir for use with a device according to claim 1.

46. A reservoir according to claim 44 comprising a body formed from three or more substantially crescent or segment shaped faces.

47. A device according to claim 1 wherein the inlet port is interengageable with a potion of the reservoir by way of a neck.

* * * * *